US012455144B2

(12) United States Patent
Roux et al.

(10) Patent No.: US 12,455,144 B2
(45) Date of Patent: Oct. 28, 2025

(54) BALLISTIC PROTECTION SYSTEM AND METHOD THEREFOR

(71) Applicants: Phillip D. Roux, Phoenix, AZ (US); Leibold Travis, Buckeye, AZ (US)

(72) Inventors: Phillip D. Roux, Phoenix, AZ (US); Leibold Travis, Buckeye, AZ (US)

( * ) Notice: Subject to any disclaimer, the term of this patent is extended or adjusted under 35 U.S.C. 154(b) by 0 days.

(21) Appl. No.: 18/395,924

(22) Filed: Dec. 26, 2023

(65) Prior Publication Data

US 2025/0207895 A1 Jun. 26, 2025

(51) Int. Cl.
*F41H 5/02* (2006.01)

(52) U.S. Cl.
CPC ..... *F41H 5/026* (2013.01)

(58) Field of Classification Search
CPC ..... F41H 5/00; F41H 5/02; F41H 5/04; F41H 5/026
USPC ..... 89/36.01, 36.02
See application file for complete search history.

(56) References Cited

U.S. PATENT DOCUMENTS 619,295 A * 2/1899 Flodquist ..... F41H 5/02 114/11
787,065 A * 4/1905 White ..... F41H 5/04 428/117
848,024 A * 3/1907 Gathmann ..... B63B 3/10 89/36.02
985,640 A * 2/1911 Stewart ..... B63B 3/10 109/81
1,035,573 A * 8/1912 Gathmann ..... B63B 3/10 89/36.02
1,508,421 A * 9/1924 Taegen ..... E05G 1/024 89/36.02
2,318,301 A * 5/1943 Eger ..... F41H 5/0457 109/81
2,399,691 A * 5/1946 Partiot ..... F41H 5/045 89/36.02
3,636,895 A * 1/1972 Kelsey ..... F41H 5/02 109/78
3,765,299 A * 10/1973 Pagano ..... F41H 7/04 89/36.08
3,765,301 A * 10/1973 Pagano ..... F41H 5/023 89/36.08
5,452,641 A * 9/1995 Kariya ..... E06B 7/082 109/78
7,080,587 B2 * 7/2006 Benyami ..... F41H 5/007 89/36.02
8,468,926 B2 * 6/2013 Treadway ..... F41H 5/023 89/36.02
8,646,373 B1 * 2/2014 Kucherov ..... F41H 5/02 89/938
12,050,088 B2 * 7/2024 Brulin ..... F41H 5/0442
2007/0089595 A1 * 4/2007 Shah ..... F41H 5/04 89/36.02
2009/0252982 A1 * 10/2009 O'Keefe ..... G02B 5/045 428/68
2010/0212484 A1 * 8/2010 Williams ..... F41H 5/0421 89/902

(Continued)

*Primary Examiner* — Joshua E Freeman
(74) *Attorney, Agent, or Firm* — Weiss & Moy, PC; Jeffrey D. Moy

(57) ABSTRACT

A ballistic panel providing ballistic protection has a plate having an exterior facing surface and an interior facing surface. A plurality of protrusions extend from the exterior facing surface. The plurality of protrusions increase an amount of surface area to contact a projectile.

19 Claims, 3 Drawing Sheets

(56) References Cited

U.S. PATENT DOCUMENTS

| | | | | |
|---|---|---|---|---|
| 2011/0174143 | A1* | 7/2011 | Sanborn | F41H 5/023 89/36.02 |
| 2016/0209178 | A1* | 7/2016 | Bailey | F41H 5/0414 |
| 2021/0285744 | A1* | 9/2021 | Roux | F41H 5/04 |
| 2021/0302129 | A1* | 9/2021 | Palser | F41H 5/0442 |

* cited by examiner

BALLISTIC PROTECTION SYSTEM AND METHOD THEREFOR

CROSS-REFERENCE TO RELATED APPLICATIONS

The present application is related to U.S. Pat. No. 11,788,819, entitled "Ballistic Protection System and Method Therefor," which was issued on Oct. 17, 2023 in the name of the inventor herein and which, in turn, is a continuation of U.S. Pat. No. 11,243,051, entitled "Ballistic Protection System and Method Therefor," which was issued on Feb. 8, 2022 in the name of the inventor herein.

TECHNICAL FIELD

The present application relates generally to armor systems, devices, and methods and, more specifically, to ballistic protection systems, devices, and related methods that utilize a protrusion design to deflect projectiles in order to increase yaw and decrease penetration.

BACKGROUND

Armor has been used for years in order to protect personnel and equipment from damage due to projectiles. More specifically, body armor has become an essential piece of safety equipment to protect military personnel, police, and security personnel as well as private citizens against various dangerous threats such as penetrating attacks by weapons, slashing, bludgeoning, etc.

Presently, there are several different types of body armor. For example, there are different types of body armor to provide protection against attacks using cutting tools or weapons such as knives, swords, axes, broken bottles, and the like, commonly referred to as edge blade protection devices/systems. Others may be designed to provide protection against objects like long nails, needles, ice picks, screwdrivers, stilettos and the like, commonly referred to as spike protection devices/systems. However, ballistic protection is the most common type of body armor and is generally referred to as "bulletproof vest" and/or "bullet resistant armor," as these types of body armor provide resistance to projectiles/bullets.

In traditional body armor ballistic protection systems, the quality of the system is directly correlated to the outcome of the individual (e.g., from as little as a soft bruise to blunt force trauma to a bullet wound to death). The type of bullets resisted is generally based on the categorized level of the armor.

Ballistic protection armor can be categorized as Level IIA, Level II, Level IIIA, Level III, or Level IV armors. Levels IIA to Level IIIA armors are designed to offer protection against most of the commonly available firearms such as 9 mm, .357 magnum, and .44 magnum firearms. Bulletproof vests at these levels use soft materials like Kevlar, which is strong and can trap and slow bullets to a complete stop.

Higher ballistic armors of Levels III and IV are designed to provide protection against large, high-velocity bullets such as from rifles and submachine guns. Body armors at these levels are in a form of hard rigid ballistic plates. The ballistic plates are generally incorporated into the vests or plate carriers. The ballistic plates are designed to stop rounds both from penetrating soft body armor and entering the body as well as protecting the users from blunt trauma associated with the dissipation of the high energy generated by a round striking the body.

Typically, ballistic plates vary in size, material, and design with each offering trade-offs regarding performance, weight, and other factors. Some may be made of steel or hardened steel or aluminum which are generally relatively effective at stopping projectiles and are relatively inexpensive, but are relatively heavy and can be uncomfortable to wear for long periods of time. Other ballistic plates/protection systems are made of multiple compressed sheets of fiber such as polyethylene that are designed to cause the bullet to become trapped within the layers. This design requires a sufficient number of woven and/or laminated fiber layers so as to prevent the projectile from penetrating all the way through the layers. This design offers a lighter weight relative to steel but is more expensive and involves a more complicated manufacturing process. Another material that is in common use for ballistic plates is a ceramic or glass plates that are compressed together and are designed to cause the projectile to disintegrate or deform upon impact. This design also offers a weight advantage over the heavy steel plates, however, once impacted, that area of the ceramic is generally no longer effective and offers no secondary protection from a second projectile impacting the same area.

In all of the aforementioned plate designs, regardless of plate configuration, the ballistic protection systems employ essentially a "plate" design, that is, a relatively flat configuration designed to prevent a bullet from penetrating the plate. Current ballistic plate designs focus on preventing the bullet from penetrating the ballistic plate the way an arrow would penetrate a target. However, projectiles come in various shapes and sizes (i.e. calibers). Bullets are also available in a wide range of configurations to include armor piercing, hollow point and ball. Bullets are also fired at a range of velocities which affect the plate configurations.

A solution to the above-mentioned problems was disclosed in U.S. Pat. No. 11,788,819, which was issued to the inventor herein on Oct. 17, 2023, and in U.S. Pat. No. 11,243,051, entitled "Ballistic Protection System and Method Therefor," which was issued to the inventor herein on Feb. 8, 2022. The ballistic protection system and method disclosed in U.S. Pat. Nos. 11,788,819 and 11,243,051 may be used to offer maximum protection regardless of the bullet configuration and velocity, to re-direct and stop projectiles, maximizing the protection to an individual wearing the ballistic protection system. However, as the ballistic protection system and method disclosed in U.S. Pat. Nos. 11,788,819 and 11,243,051 may be comprised of multiple plates, this may involve a relatively greater manufacturing process and expense.

Therefore, it would be desirable to provide a ballistic protection system and method that overcomes the problems discussed above. The ballistic protection system and method would offer maximum protection regardless of the bullet configuration and velocity of the projectile. The ballistic protection system and method would be able to re-direct and stop projectiles regardless of their configuration and velocity in order to maximize the protection to an individual wearing the ballistic protection system. The ballistic protection system and method would be able to guide and stop projectiles.

The present disclosure addresses the above-mentioned problems as well as provides other, related advantages.

SUMMARY

In accordance with one embodiment of the present invention, a ballistic panel providing ballistic protection is disclosed. The ballistic panel comprises: a plate having a rear surface, a front surface, and a central region; a first plurality of protrusions formed across the front surface of the plate. The plurality of protrusions formed on the front surface of the plate are angled in a first direction toward the central region of the plate; and wherein the second plurality of protrusions formed on the front surface of the plate are angled in a second direction toward the central region of the plate.

In accordance with another embodiment of the present invention, a ballistic panel providing ballistic protection is disclosed. The ballistic panel comprises: a plate having a rear surface, a front surface, and a central region; a first plurality of protrusions formed across the front surface of the plate, the first plurality of protrusions increasing an amount of surface area to contact a projectile; a second plurality of protrusions formed across the front surface of the plate, the second plurality of protrusions increasing an amount of surface area to contact a projectile; an apex formed at the central region of the plate; wherein the first plurality of protrusions formed on the front surface of the plate are angled in a first direction toward the central region of the plate; and wherein the second plurality of protrusions formed on the front surface of the plate are angled in a second direction toward the central region of the plate.

In accordance with another embodiment of the present invention, a ballistic panel providing ballistic protection is disclosed. The ballistic panel comprises: a plate having a rear surface, a front surface, and a central region; a first plurality of protrusions formed across the front surface of the plate, wherein the first plurality of protrusions comprises a first pair of side walls and a first top surface, the first plurality of protrusions increasing an amount of surface area to contact a projectile; a second plurality of protrusions formed across the front surface of the plate, wherein the second plurality of protrusions comprises a second pair of side walls and a second top surface, the second plurality of protrusions increasing an amount of surface area to contact a projectile; an apex formed at the central region of the plate; wherein the first plurality of protrusions formed on the front surface of the plate are angled in a first direction toward the central region of the plate; wherein adjacent protrusions of the first plurality of protrusions formed on the front surface of the plate define a first plurality of channels therebetween; wherein the second plurality of protrusions formed on the front surface of the plate are angled in a second direction toward the central region of the plate; wherein adjacent protrusions of the second plurality of protrusions formed on the front surface of the plate define a second plurality of channels therebetween; and wherein the first and second top surfaces are each inwardly angled in a direction toward the central region of the plate.

BRIEF DESCRIPTION OF THE DRAWINGS

The present application is further detailed with respect to the following drawings. These figures are not intended to limit the scope of the present application, but rather, illustrate certain attributes thereof. In the descriptions that follow, like parts are marked throughout the specification and drawings with the same numerals, respectively. The drawing figures are not necessarily drawn to scale and certain figures can be shown in exaggerated or generalized form in the interest of clarity and conciseness. The disclosure itself, however, as well as a preferred mode of use and further objectives and advantages thereof, can be best understood by reference to the following detailed description of illustrative embodiments when read in conjunction with the accompanying drawings, wherein.

DESCRIPTION OF THE APPLICATION

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences may be accomplished by different embodiments that are also intended to be encompassed within the spirit and scope of this disclosure.

Embodiments of the exemplary ballistic protection device, system, and method (hereinafter device) employ a re-direction (Non-Linear) technology designed to cause additional surface area of a projectile to make contact with the ballistic protection device. In this way, the present invention can be utilized regardless of material (e.g., steel, ceramic, polyethylene, aluminum, etc.). The exemplary ballistic protection device generally comprises a plate that has an exterior (i.e. projectile facing) surface that is comprised of angled protrusions utilized to cause more of the surface area of the projectile to come into contact with the plate. The interior facing surface can be substantially flat or curved.

The angled protrusions may cause the projectile to begin to yaw or be deflected and/or redirected; the result is that an increasing amount of the surface of the projectile is placed into contact with the ballistic protection device. The more surface area of the plate that is able to contact the surface area of the projectile, the more blunt force trauma energy can be dispersed and the more effective that ballistic protection device can be in serving its primary function, preventing a projectile from penetrating and otherwise causing damage to the person or object on the other side.

Figure 1:
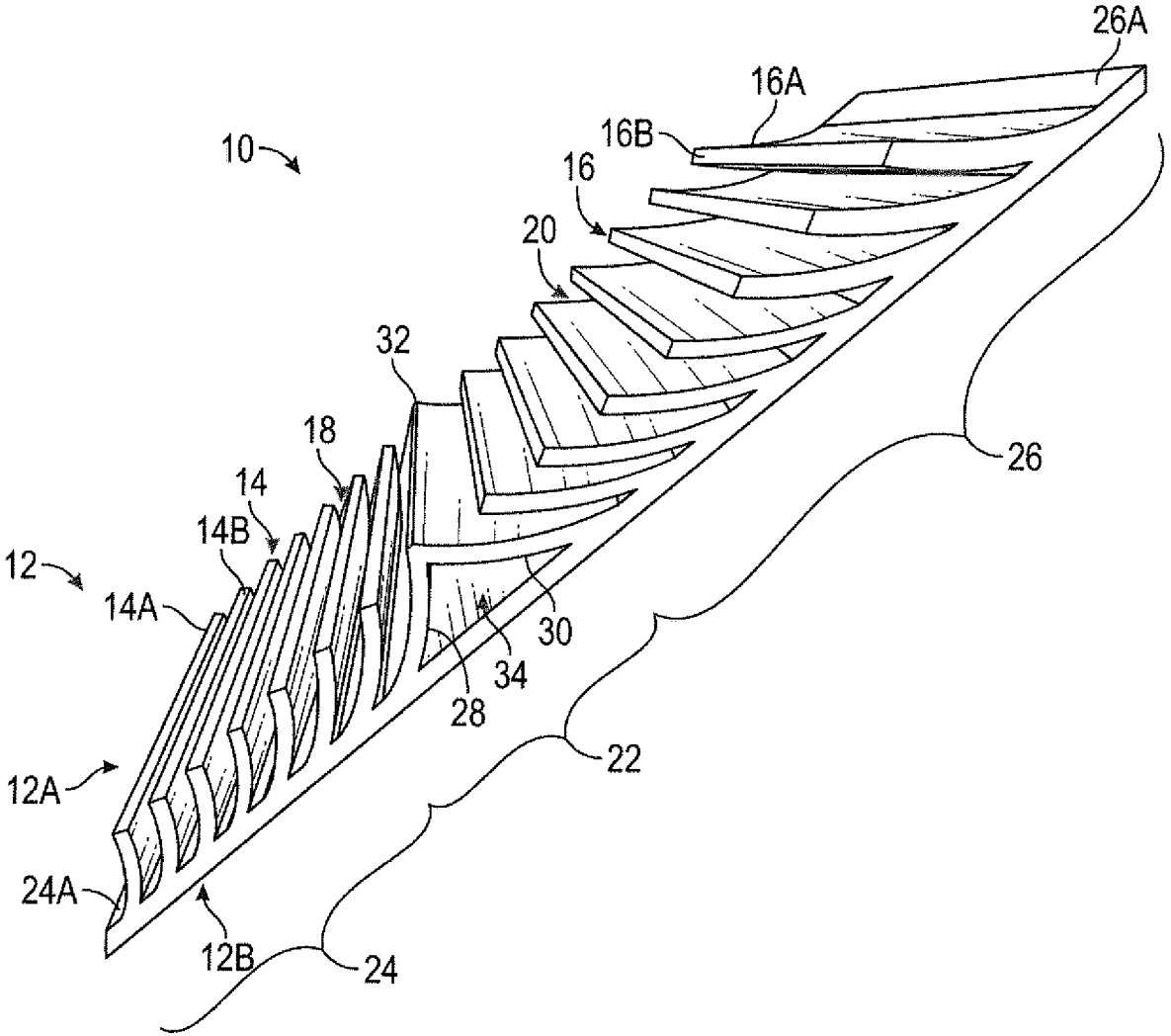
FIG. 1 is an elevated perspective view of an exemplary ballistic protection system, in accordance with one aspect of the present disclosure.
Figure 2:
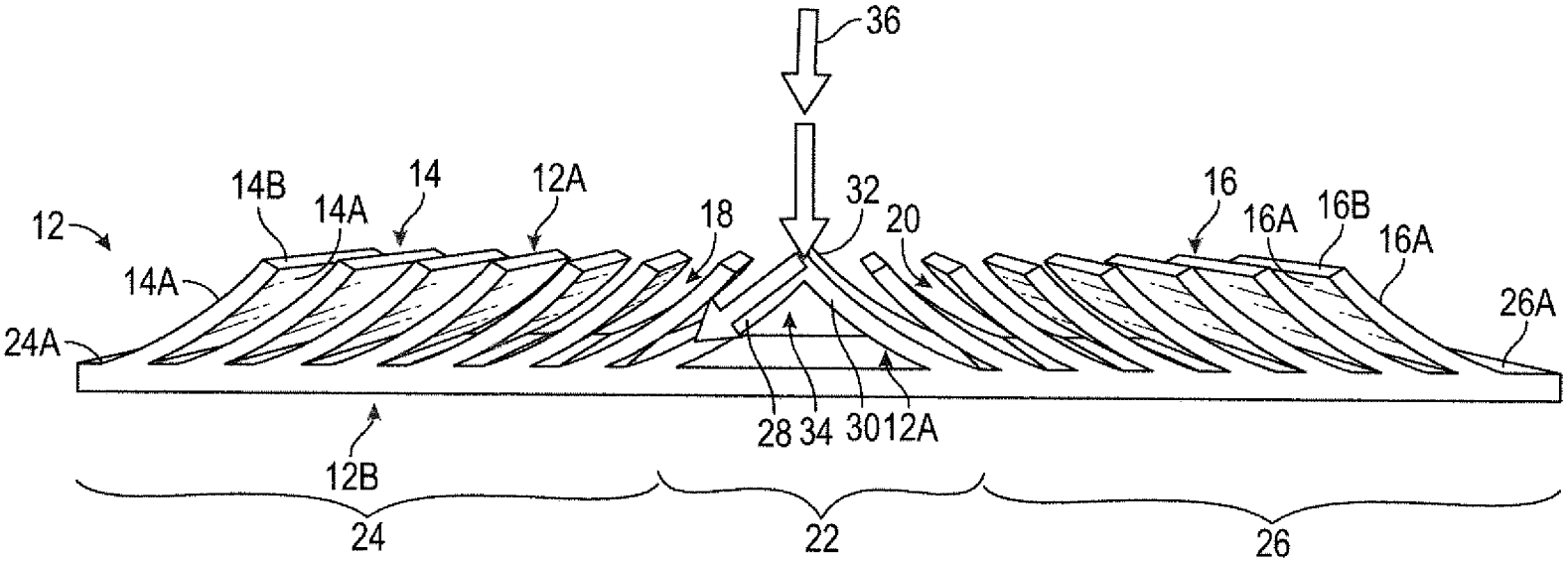
FIG. 2 is another perspective view of the ballistic protection system of FIG. 1, providing an exemplary illustration of a pathway that may be taken by a projectile coming into contact with the ballistic protection system.
Figure 3:
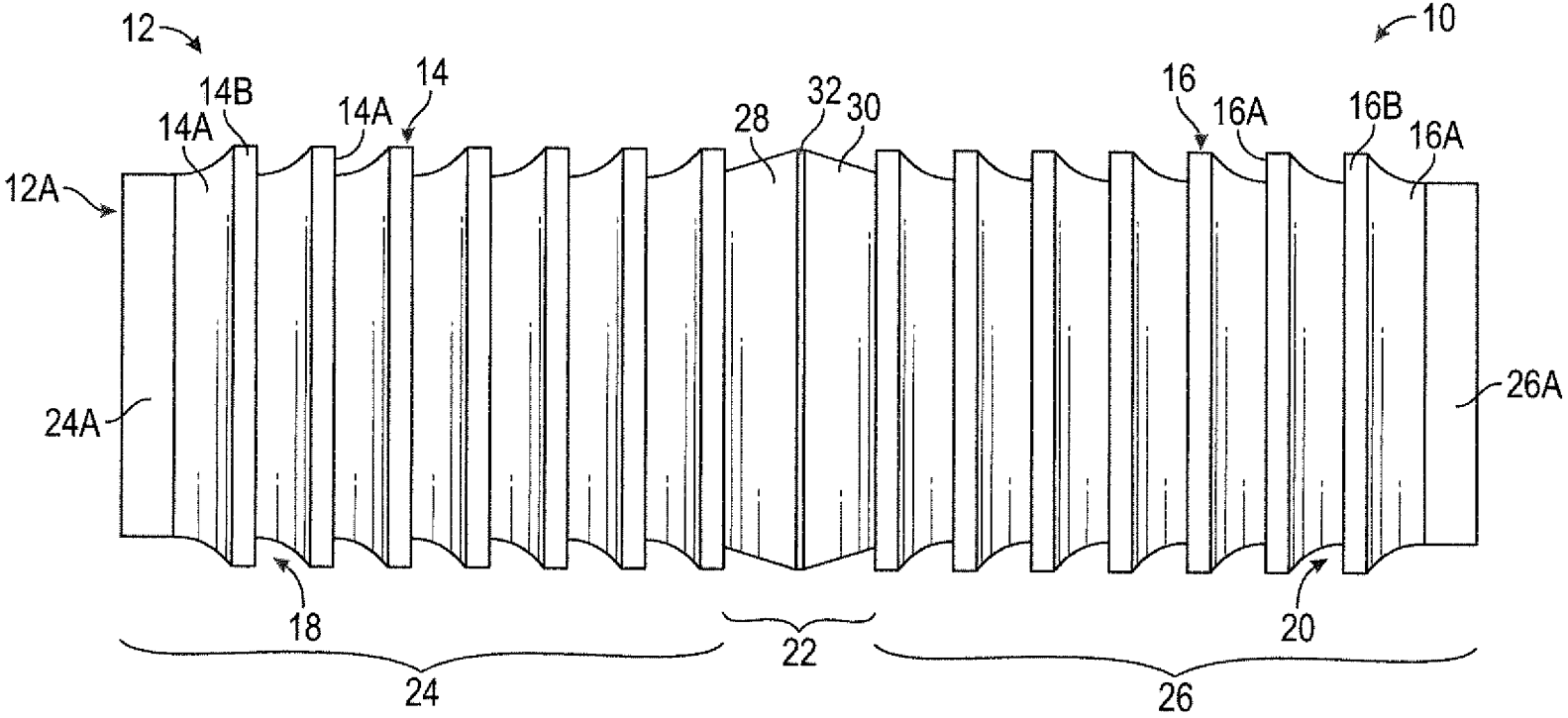
FIG. 3 is a front view of the ballistic protection system of FIG. 1.

FIGS. 1-3, together, disclose embodiments of a ballistic protection device 10 (hereinafter device 10). Referring first to FIG. 1, one exemplary embodiment of the device 10 may be seen. The device 10, which may have a substantially elongated configuration, may be generally comprised of a plate 12 having an exterior facing surface 12A and an interior facing surface 12B. The exterior facing surface 12A may be the surface furthest from a body of a wearer of the device 10 and may be the surface that faces an oncoming projectile. The interior facing surface 12B may be the surface closest to a body of a wearer of the device 10. The interior facing surface 12B may be all substantially flat or curved to provide a more comfortable feel when placed against a body of the wearer.

The plate 12 may have a plurality of elongated protrusions 14 and 16 formed thereon. In the embodiment shown, the protrusions 14 and 16 may comprise substantially finlike structures. With particular reference to FIG. 3, as shown, the protrusions 14 and 16 may run an entire height (vertically) along the plate 12. However, this is shown as one embodiment and the protrusions 14 and 16 may run vertically, horizontally, crisscross, in a curved pattern, or in other designs.

Referring again to FIG. 1, the protrusions 14 will be discussed in more detail. As shown in this embodiment, the protrusions 14 are each of the same geometrical configuration. As can be seen from FIGS. 1 and 3, each protrusion 14 may be substantially rectangular in shape. Each protrusion 14 may be formed of a pair of side walls 14A and a top surface 14B. In the embodiment shown, the side walls 14A of each protrusion 14 may be substantially angled or curved in parallel with each other, such that each protrusion 14 projects in a first direction that is oriented toward a central region 22 of the device 10. In the embodiment shown, the top surface 14B of each protrusion 14 may be inwardly angled in a direction toward the central region 22. In one embodiment, the protrusions 14 may be arced in the direction of the central region 22. Each protrusion 14 may extend outwardly from the plate 12. The protrusions 14 may be equidistantly spaced apart along a first, left region 24 of the device 10.

As shown in this embodiment, adjacent protrusions 14 may define channels 18 therebetween. The channels 18 may take on a substantially angled "V" shaped formation. Alternatively, the channels 18 may take on another formation, depending on the configuration of the protrusions 14.

Referring again to FIG. 1, the protrusions 16 will be discussed in more detail. Similar to the protrusions 14, the protrusions 16 are each of the same geometrical configuration. As can be seen from FIGS. 1 and 3, each protrusion 16 may be substantially rectangular in shape. Each protrusion 16 may be formed of a pair of side walls 16A and a top surface 16B. In the embodiment shown, the side walls 16A of each protrusion 16 may be substantially angled or curved in parallel with each other, such that each protrusion 16 projects in a second direction (opposite the first direction in which each protrusion 14 projects, as discussed above) that is oriented toward a central region 22 of the device 10. In the embodiment shown, the top surface 16B of each protrusion 16 may be inwardly angled in a direction toward the central region 22. In one embodiment, the protrusions 16 may be arced in the direction of the central region 22. Each protrusion 16 may extend outwardly from the plate 12. The protrusions 16 may be equidistantly spaced apart along a second, right region 26 of the device 10.

As shown in this embodiment, adjacent protrusions 16 may define channels 20 therebetween. The channels 20 may take on a substantially angled "V" shaped formation. Alternatively, the channels 20 may take on another formation, depending on the configuration of the protrusions 16.

The device 10 may generally include left region 24 and right region 26, with the central region 22 positioned between the left region 24 and right region 26. Referring to the left region 24, left region 24 may originate from a left lateral portion 24A of the device 10 and terminate at the central region 22. Protrusions 14 and channels 18 may be formed in the left region 24. With particular reference to FIG. 3, the left lateral portion 24A may comprise a relatively flat surface and may extend laterally outward in a direction away from the central region 22.

Referring to the right region 26, right region 26 may originate from a right lateral portion 26A of the device 10 and terminate at the central region 22. Protrusions 16 and channels 20 may be formed in the right region 26. With particular reference to FIG. 3, the right lateral portion 26A may comprise a relatively flat surface and may extend laterally outward in a direction away from the central region 22.

Referring now to FIG. 2, as can be seen in the embodiment shown, with protrusions 14 projecting in a first direction that is oriented toward the central region 22 and protrusions 16 projecting in a second direction that is oriented toward the central region 22, left region 24 and right region 26 of the device 10 can be substantially mirror images of one another, as can be protrusions 14 and protrusions 16. However, this is shown as one embodiment, and the protrusions 14 or 16 may have other configurations such that left region 24 and right region 26 of the device 10 are not substantially mirror images of one another. As shown in this embodiment, seven protrusions 14 are provided in left region 24 and seven protrusions 16 are provided in right region 26. However, it should be understood that the number of protrusions 14 and protrusions 16 could deviate from this amount. For example, it may be desired to increase or decrease the number of protrusions 14 and protrusions 16 to accommodate the size of the wearer of the device 10.

As shown in this embodiment, adjacent "V" shaped channels 18 may share a protrusion 14. Channels 18 may be equidistantly spaced apart. In the embodiment shown, protrusions 14 may be attached along the left region 24 of the plate 12, and angled or curved in the direction of the central region 22. Similarly, adjacent "V" shaped channels 20 may share a protrusion 16. Channels 20 may be equidistantly spaced apart. In the embodiment shown, protrusions 16 may be attached along the right region 26 of the plate 12, and angled or curved in the direction of the central region 22.

Referring to the central region 22, as shown in this embodiment, central region 22 may include side walls 28 and 30. Side walls 28 and 30 may extend outwardly from exterior facing surface 12A of plate 12 and may be conjoined with one another at an apex 32. In the embodiment shown, apex 32 is positioned in a center portion of the plate 12. As can be seen in FIG. 2, in this embodiment, apex 32 extends outwardly in a direction away from the interior facing surface 12B of the plate 12 to a position that is further from interior facing surface 12B compared to positions of top surfaces 14B and 16B of protrusions 14 and 16, respectively, which are closer to interior facing surface 12B of the plate 12. However, this is shown as one embodiment, and the apex 32 and top surfaces 14B and 16B may be substantially coplanar with one another. Together with a portion of exterior facing surface 12A of the plate 12, side walls 28 and 30 may define a cavity 34 therebetween. Cavity 34 may be substantially triangular shaped.

The angled or curved configuration of protrusions 14 and protrusions 16 and, correspondingly, channels 18 and 20, may cause the projectile to yaw or be deflected and/or redirected; the result is that an increasing amount of a surface of the projectile may be placed into contact with the plate 12. The more surface area of the plate 12 that is able to contact the surface area of the projectile, the more blunt force trauma energy can be dispersed and the more effective that device 10 can be in serving its primary function, preventing a projectile from penetrating and otherwise causing damage to the wearer or object on the other side of the plate 12. It should be noted that the angle and depth of the "V" shaped channels 18 and 20 may vary depending on the type of projectile that the plate 12 is designed to stop. In accordance with one embodiment, the angled or curved configuration of protrusions 14 and protrusions 16 may cause the initial contact with the projectile to slow and guide the projectile into a direction so that the projectile may contact multiple protrusions 14 and protrusions 16 which may redirect and/or stop the projectile.

Referring again to FIG. 2, arrows 36 provide an exemplary illustration of a pathway that a projectile may take upon coming into contact with the device 10. A projectile may reach the apex 32 of the device 10 and then be directed by protrusion 14 and side wall 28 into a channel 18. (Likewise, a projectile may reach the apex 32 of the device 10 and then be directed by protrusion 16 and side wall 30 into a channel 20.) Similarly, a projectile may reach the left region 24 of the device 10 and then be directed by adjacent protrusions 14 into one of the channels 18. Similarly still, a projectile may reach the right region 26 of the device 10 and then be directed by adjacent protrusions 16 into one of the channels 20. In these various ways, a projectile will be prevented from penetrating and otherwise causing damage to the wearer or object on the other side of the plate 12.

The foregoing description is illustrative of particular embodiments of the application, but is not meant to be a limitation upon the practice thereof. The following claims, including all equivalents thereof, are intended to define the scope of the application.

What is claimed is:

1. A ballistic panel providing ballistic protection comprising:

a plate having a rear surface, a front surface, and a central region;

a first plurality of protrusions formed across the front surface of the plate;

a second plurality of protrusions formed across the front surface of the plate;

wherein the first plurality of protrusions formed on the front surface of the plate are angled in a first direction toward the central region of the plate;

wherein the second plurality of protrusions formed on the front surface of the plate are angled in a second direction toward the central region of the plate; and wherein the central region of the plate comprises a first side wall and a second side wall wherein the first and second side walls are conjoined at an apex.

2. The ballistic panel of claim 1, wherein each protrusion of the first plurality of protrusions comprises a first pair of side walls and a first top surface, and wherein each protrusion of the second plurality of protrusions comprises a second pair of side walls and a second top surface, wherein the first and second top surfaces are each inwardly angled in a direction toward the central region of the plate.

3. The ballistic panel of claim 1, wherein the apex extends outwardly from the plate to a first position and the first and second plurality of protrusions extend outwardly from the plate to a second position, wherein a distance between the first position and the rear surface of the plate is greater than a distance between the second position and the rear surface of the plate.

4. The ballistic panel of claim 1, wherein the first side wall of the central region, the second side wall of the central region, and the front surface of the plate define a cavity therebetween.

5. The ballistic panel of claim 1, wherein adjacent protrusions of the first plurality of protrusions define a first plurality of channels therebetween.

6. The ballistic panel of claim 5, wherein the first plurality of channels are "V" shaped.

7. The ballistic panel of claim 5, wherein adjacent protrusions of the second plurality of protrusions define a second plurality of channels therebetween.

8. The ballistic panel of claim 7, wherein the second plurality of channels are "V" shaped.

9. A ballistic panel providing ballistic protection comprising:

a plate having a rear surface, a front surface, and a central region;

a first plurality of protrusions formed across the front surface of the plate, the first plurality of protrusions increasing an amount of surface area to contact a projectile;

a second plurality of protrusions formed across the front surface of the plate, the second plurality of protrusions increasing an amount of surface area to contact a projectile;

an apex formed at the central region of the plate;

wherein the first plurality of protrusions formed on the front surface of the plate are angled in a first direction toward the central region of the plate; and wherein the second plurality of protrusions formed on the front surface of the plate are angled in a second direction toward the central region of the plate.

10. The ballistic panel of claim 9, wherein each protrusion of the first plurality of protrusions comprises a first pair of side walls and a first top surface, and wherein each protrusion of the second plurality of protrusions comprises a second pair of side walls and a second top surface, wherein the first and second top surfaces are each inwardly angled in a direction toward the central region.

11. The ballistic panel of claim 9, wherein the central region comprises a first side wall and a second side wall, wherein the first and second side walls are conjoined at the apex.

12. The ballistic panel of claim 11, wherein the first side wall of the central region, the second side wall of the central region, and the front surface of the plate define a cavity therebetween.

13. The ballistic panel of claim 9, wherein the apex extends outwardly from the plate to a first position and the first and second plurality of protrusions extend outwardly from the plate to a second position, wherein a distance between the first position and the rear surface of the plate is greater than a distance between the second position and the rear surface of the plate.

14. The ballistic panel of claim 9, wherein adjacent protrusions of the first plurality of protrusions define a first plurality of channels therebetween.

15. The ballistic panel of claim 14, wherein the first plurality of channels are "V" shaped.

16. The ballistic panel of claim 14, wherein adjacent protrusions of the second plurality of protrusions define a second plurality of channels therebetween.

17. The ballistic panel of claim 16, wherein the second plurality of channels are "V" shaped.

18. A ballistic panel providing ballistic protection comprising:

a plate having a rear surface, a front surface, and a central region;

a first plurality of protrusions formed across the front surface of the plate, wherein the first plurality of protrusions comprises a first pair of side walls and a first top surface, the first plurality of protrusions increasing an amount of surface area to contact a projectile;

a second plurality of protrusions formed across the front surface of the plate, wherein the second plurality of protrusions comprises a second pair of side walls and a second top surface, the second plurality of protrusions increasing an amount of surface area to contact a projectile;

an apex formed at the central region of the plate;

wherein the first plurality of protrusions formed on the front surface of the plate are angled in a first direction toward the central region of the plate;

wherein adjacent protrusions of the first plurality of protrusions formed on the front surface of the plate define a first plurality of channels therebetween;

wherein the second plurality of protrusions formed on the front surface of the plate are angled in a second direction toward the central region of the plate;

wherein adjacent protrusions of the second plurality of protrusions formed on the front surface of the plate define a second plurality of channels therebetween; and wherein the first and second top surfaces are each inwardly angled in a direction toward the central region of the plate.

19. The ballistic panel of claim 18 wherein the first plurality of channels and the second plurality of channels are "V" shaped.

* * * * *